US008221272B2

(12) United States Patent
Koncelik, Jr.

(10) Patent No.: US 8,221,272 B2
(45) Date of Patent: Jul. 17, 2012

(54) METHOD AND APPARATUS FOR A GOLF MAT

(76) Inventor: Lawrence J. Koncelik, Jr., East Hampton, NY (US)

( * ) Notice: Subject to any disclaimer, the term of this patent is extended or adjusted under 35 U.S.C. 154(b) by 270 days.

(21) Appl. No.: 12/791,153

(22) Filed: Jun. 1, 2010

(65) Prior Publication Data

US 2011/0256947 A1 Oct. 20, 2011

Related U.S. Application Data

(60) Provisional application No. 61/342,450, filed on Apr. 14, 2010.

(51) Int. Cl.
*A63B 69/36* (2006.01)

(52) U.S. Cl. ..... 473/478; 473/379; 473/409

(58) Field of Classification Search ..... 473/150, 473/157, 160, 162, 168, 278, 279, 409
See application file for complete search history.

(56) References Cited

U.S. PATENT DOCUMENTS 3,599,982 A * 8/1971 Elesh ..... 473/278
3,639,923 A * 2/1972 Stewart ..... 473/269
5,110,133 A * 5/1992 Durso ..... 473/218
5,390,925 A * 2/1995 Wiltse ..... 473/160
5,944,615 A * 8/1999 Lee ..... 473/279
6,135,895 A * 10/2000 Estivo et al. ..... 473/278
6,450,895 B1 * 9/2002 Galluzzo, Jr. ..... 473/279
7,549,932 B1 6/2009 Miyamoto ..... 473/278
2008/0004126 A1 * 1/2008 Dantas ..... 473/278
2008/0032811 A1 2/2008 Bearden ..... 473/278

* cited by examiner

*Primary Examiner* — Nini LeGesse
(74) *Attorney, Agent, or Firm* — Walter J. Tencza, Jr.

(57) ABSTRACT

A golf mat is disclosed comprising a body portion or ground sheet; and a means for holding the body portion in a position which is elevated a first distance above a ground surface. The means for holding the body portion may be connected to the body portion substantially perpendicular to the body portion. The body portion and the means for holding the body portion may be configured so that when the body portion is placed so that it is substantially parallel to the ground surface and elevated above the ground surface, and the means for holding the body portion is in contact with the ground surface, the majority of the body portion is not in contact with the ground surface so that there is a cavity beneath the body portion in which natural grass from the ground surface can grow without being restrained at least to a height of the first distance. The body portion of the golf mat may include a plurality of openings, wherein natural grass from the ground surface can grow through the plurality of openings of the body portion.

26 Claims, 11 Drawing Sheets

METHOD AND APPARATUS FOR A GOLF MAT

CROSS REFERENCE TO RELATED APPLICATION(S)

The present application claims the priority of U.S. provisional patent application Ser. No. 61/342,450, titled "Golf ball anti divot mat" filed on Apr. 14, 2010, inventor and applicant Lawrence J. Koncelik, Jr.

FIELD OF THE INVENTION

This invention relates to improved methods and apparatus concerning golfing mats.

BACKGROUND OF THE INVENTION

Striking a golf ball on a fairway often causes a divot. This is because a golf club iron, or fairway wood, or other golf club, when swung properly, impacts with the ball while the golf club head is descending and thus a chunk of earth and dirt is taken at or about the area of where the ball is struck from. Therefore golf driving mats are generally constructed with an artificial turf like material that has some elasticity to deflect downward, and absorb much of the impact of the golf cub and gives the golfer the sensation of taking a divot from the natural playing surface However, golf or golfing mats are not always suitable for a golfer to practice from. Often a golfer seeks to practice hitting golf balls or swing making practice swings in his own back yard or on a grass area that he or she does not want to take divot from when he or she strikes downwardly on the ball and through and into the ground below. Prior golf ball mats are heavy and expensive and if a mat is not used, the scarring of the lawn caused by the golf club's divot action makes such areas expensive to maintain due to the constant need to fill in the divot holes with soil and replant the grass. In addition, existing driving mats and ball support surfaces are often unsightly both when they are placed on a lawn and after they are moved from the lawn when considering that they often smother and kill the grass below the mat when the mat is left in place for more than a day or two.

Furthermore, if a golfer sets a conventional golf tee in his lawn and proceeds to impact it with his golf club while practicing swinging, he is liable to, on occasion, miss the tee and hit the lawn instead. This would likely cause the head of the golf club to gouge a divot out of the lawn. The golf ball tee is also likely to fly off when impacted by a golf club head, and thus the golfer would have to bend over and replace the tee every time it flies away. There is a need for substantial improvements to overcome such problems.

There are various devices known in the prior art for golfing mats. U.S. Pat. No. 7,549,932 to Miyamoto, incorporated by reference herein, discloses a flexible sheet 10 having a mid portion 10d which can be downwardly deflected during swinging of a golf club head to strike a golf ball. (Miyamoto, Col. 2, Ins. 24-48, FIG. 2). U.S. patent application number 2008/0032811 to Bearden, incorporated by reference herein, discloses a beam 20 suspended over a void 12, such that a middle portion 24 of the beam 20 deflects downward when a golf club 70 drives the middle portion 24 downward. (Bearden, paragraphs 18-19). Bearden also discloses a plurality of short studs 8, which inhibit the apparatus 1 from sliding along the ground. (Bearden, pg. 2, paragraph 17, FIG. 4)

SUMMARY OF THE INVENTION

One or more embodiments of the present invention relate generally to enhancing the practice of driving of golf balls, and practicing a golf swing; and more particularly to apparatus and method to enable enhanced simulation of actual use of golf clubs on a home lawn or at driving ranges.

It is an object of one or more embodiments of the present invention to provide an improved apparatus and method to meet the need of a better golf or golfing mat.

In one or more embodiments, a flexible ground sheet or body portion is placed in between the ground and the swinging golf club head in the place where the golf club head would normally impact with the ground. In at least one embodiment, the ground sheet or at least a substantial portion of the ground sheet is elevated above a ground surface so that the ground sheet will not smother and kill the grass that might grow beneath it. The ground sheet provides a resiliently downwardly yieldable barrier between the ground and a swinging golf club head acting to impact it and to sweepingly engage and downwardly deflect a portion of the sheet and prevents the club head from digging into the ground below it.

In at least one embodiment of the present application, a golf mat is disclosed comprising: a body portion or ground sheet; and a means for holding the body portion in a position which is elevated a first distance above a ground surface. The means for holding the body portion may be connected to the body portion so that the means for holding the body portion is substantially perpendicular to the body portion. The body portion and the means for holding the body portion may be configured so that when the body portion is placed so that it is substantially parallel to the ground surface and elevated above the ground surface, and the means for holding the body portion is in contact with the ground surface, the majority of the body portion is not in contact with the ground surface so that there is a cavity beneath the body portion in which natural grass from the ground surface can grow without being restrained at least to a height of the first distance.

The body portion of the golf mat may include a plurality of openings, wherein natural grass from the ground surface can grow through the plurality of openings of the body portion. The golf mat may further include a first inclined section and a second inclined section, wherein the means for holding the body portion includes first and second members, each of which is substantially perpendicular to the body portion, wherein the first inclined section has a first end which is connected to a first end of the first member, wherein the first inclined section has a second end which is connected to a first end of the body portion, wherein the second inclined section has a first end which is connected to a first end of the second member, wherein the second inclined section has a second end which is connected to a second end of the body portion, wherein a second end of the first member is configured to contact the ground surface when the body portion is substantially parallel to the ground surface and when the golf mat is supported by the ground surface, and wherein a second end of the first member is configured to contact the ground surface when the body portion is substantially parallel to the ground surface and when the golf mat is supported by the ground surface.

The means for holding the body portion of the golf mat may further include first and second sharp edged members which can be driven into the ground surface when the body portion is substantially parallel to the ground surface. The means for holding the body portion may include first and second flat members each of which has a surface which is substantially parallel or parallel to the sharp edge of the first and second sharp edged members, respectively. The first and second flat members may support the golf mat on the ground surface, contact the ground surface, and inhibit the first and second sharp edged members from being driven more than a second distance into the ground surface. The first and second flat members may support the golf mat on the ground surface, penetrate into the ground at an angle and inhibit the first and second sharp edged members from being driven more than a second distance into the ground surface.

Each of the openings of the body portion may be an elongated slot. The body portion may have a top surface and a bottom surface, and the top surface of the body portion may include an artificial grass material. The body portion may be made of a flexible material which flexes when a golf club head impacts the flexible material. The golf mat may also include a golf ball support which is inserted into one of the openings in the body portion.

At least one embodiment of the present application may also include method comprising holding a body portion of a golf mat in a position which is elevated a first distance above a ground surface, wherein the body portion is held so that there is a cavity in which natural grass from the ground surface can grow unrestrained at least to a height of the first distance. The method may further include placing a golf ball on a top surface of the body portion and hitting the golf ball off of the golf mat by swinging a golf club in order to hit the golf ball with a golf club head of the golf club.

DETAILED DESCRIPTION OF THE DRAWINGS

Figure 1A:
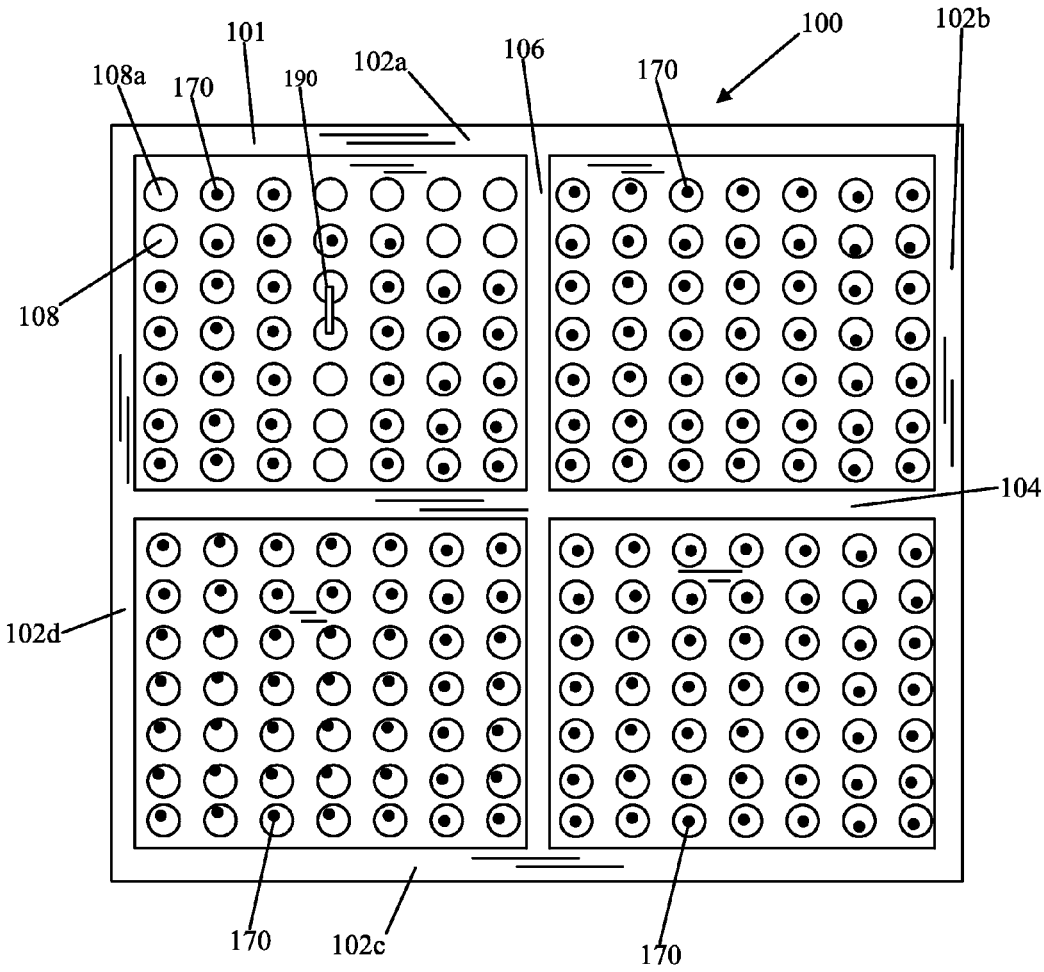
FIG. 1A shows a top view of a golf mat in accordance with an embodiment of the present invention.

FIG. 1A shows a top view of a golfing mat 100 in accordance with an embodiment of the present invention. FIGS. 1B-1F show rear, left side, front, right side, and bottom views respectively of the golfing mat 100 of FIG. 1A. The golfing mat 100 includes body portion 101 shown in FIG. 1A. The golfing mat 100 includes peripheral support members 102*a*, 102*b*, 102*c*, and 102*d*. The golfing mat 100 also includes support members 104 and 106. The golfing mat 100 also includes a plurality of holes or openings 108, including hole or opening 108*a*. Referring to FIGS. 1B-1F, the golfing mat 100 includes a plurality of stakes, pointed posts, or pointed members 110*a*, 110*b*, 110*c*, 110*d*, 110*e*, 110*f*, 110*g*, and 110*h*, for inserting in a ground or earth surface, such as into ground 150, shown by horizontal dashed lines in FIGS. 1B-1E. In FIGS. 1B-1E, the stakes 110*a-h* are shown inserted into the ground 150.

In the configuration of FIGS. 1B-1E, blades of grass 170, shown by substantially vertical dashed lines, pass through the openings 108 (not shown in FIGS. 1B-1E, but shown in FIG. 1A). A golf ball 160 is shown placed on several blades of grass of 170, so that the golf ball does not touch the top surface 101*a* of the golfing mat 100. In FIG. 1A, the tops of blades of grass 170 are shown as dark dots within openings 108. There may be one or more blades of grass 170, passing up through each of openings 108, including opening 108*a*. The golf ball 160 may also be placed directly on the surface of the ground sheet, such as a top surface 101*a* of the body portion or ground sheet 101, shown in FIG. 1B, such as when no grass grows through the openings 108 of the ground sheet or body portion 101 or after the grass is shaved off from the top surface 101*a* of the ground sheet or body portion 101 by a descending golf club head that skids across the surface 101*a* of the ground sheet or body portion 101.

Figure 1B:
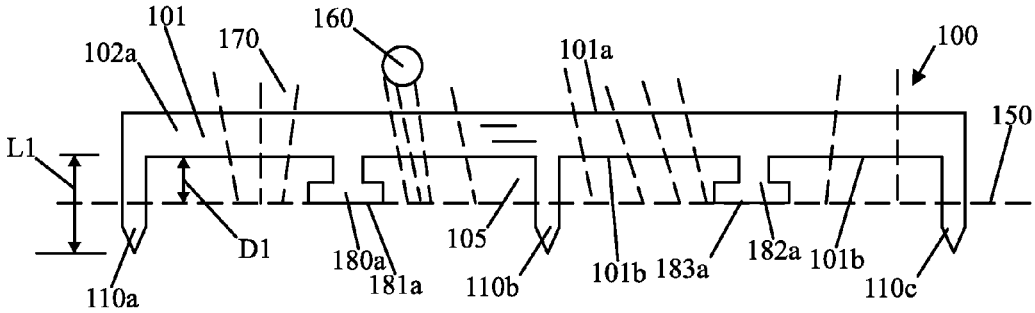
FIG. 1B shows a rear view of the golf mat of FIG. 1A.
Figure 1C:
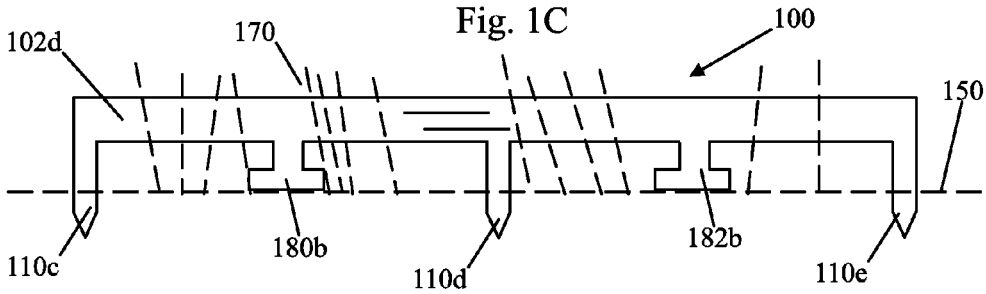
FIG. 1C shows a left side view of the golf mat of FIG. 1A.
Figure 1D:
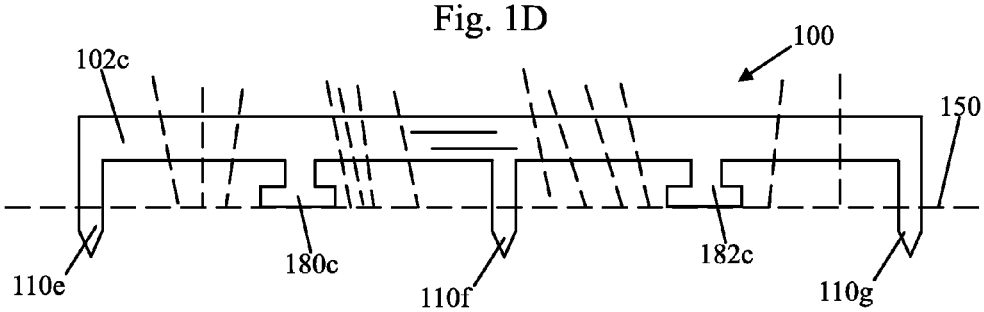
FIG. 1D shows a front view of the golf mat of FIG. 1A.
Figure 1E:
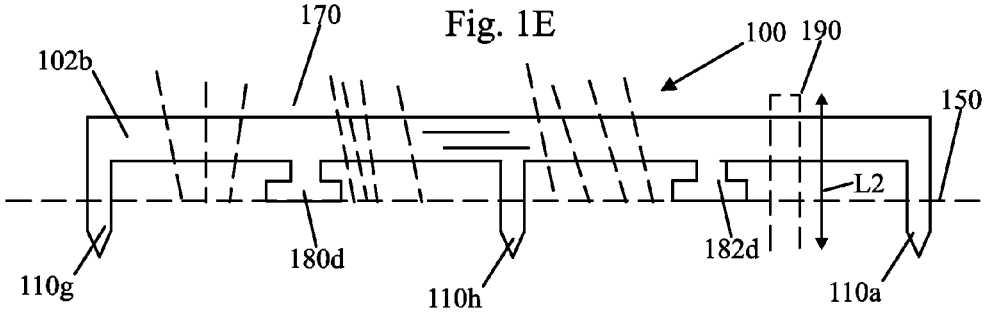
FIG. 1E shows a right side view of the golf mat of FIG. 1A.
Figure 1F:
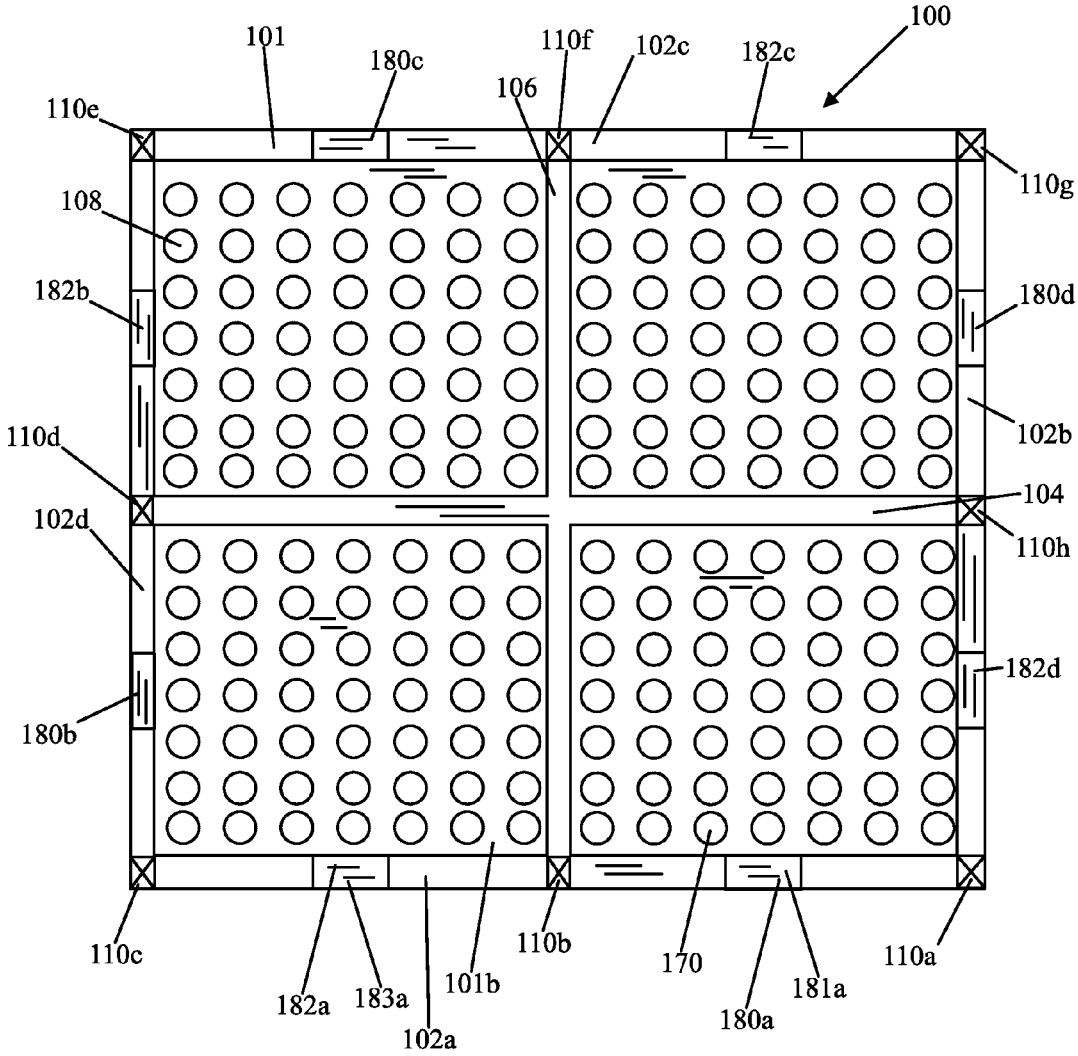
FIG. 1F shows a bottom view of the golf or golfing mat of FIG. 1A.

As shown by FIG. 1F, the body portion has a bottom surface 101*b*. Other than the stakes or legs 110*a-g* and the support members 180*a-d* and 182*a-d* shown in FIG. 1F, the mat 100 is configured to not touch a ground surface, such as 150 in FIGS. 1B-1E. Thus the majority of the bottom surface, such as 101*b* or the majority of 101*b*, does not touch the ground surface 150 as shown by FIGS. 1B-1E, which inhibits the mat 100 from killing grass underneath the bottom surface 101*b* when the mat 100 is set up as in FIGS. 1B-1E. The grass blades 170 are not shown in the view of FIG. 1F.

The mat 100 may be solid and flexible, and may be made of a composite of carbon fiber and plastic or of polyethylene plastic or any other flexible material. The stakes or legs 110*a*-110*i* may be inserted into the ground 150 so that the body portion 101 of the mat 100 is a distance D1 above or off of the ground surface 150 shown in FIG. 1B. The length of each stake or leg of stakes 110*a*-110*i*, may be L1 as shown in FIG. 1B, which typically will be longer than D1 to allow the stakes 110*a*-110*i* to be inserted into the ground 150 and to leave an appropriate space D1, which may be one half of an inch.

The members or cross members 104 and 106 reinforce the mat 100 to keep it relatively stiff and planar. The holes 108 can allow grass blades 170 to grow to partially or completely cover or obscure the surface 101*a* of the mat 100. Each of the holes 108, such as hole 108*a*, shown in FIG. 1A may be circular and may have a diameter, such three quarters of an inch, which is much smaller than a typical golf club head, and which is small enough to prevent a typical golf club head or a golf ball from going through any of the holes 108.

Each of the holes 108 is shown as circular or substantially circular in FIG. 1A. However, the holes 108 can be or can be replaced by holes of any other shape. The holes 108 can be various shapes or sizes. For example, the holes 108 can range in size from one half-inch to three quarters of an inch in both length and width. The distance D1, shown in FIG. 1B, may be one half of an inch. The mat 100 may include the support structures 180*a-d* and 182*a-d*, which unlike the stakes 110*a*-110*i*, do not go into the ground 150 but prevent the body portion 101 from substantially bending or from becoming permanently deformed, or sagging or drooping over time, in response to repeated golf club head impacts to the mat 100 when, for example, striking the ball 160, or some other golf ball or when practicing a golf swing by hitting the top surface 101*a* of the mat 100. The support structures 180*a-d* and 182*a-d* may have flat or substantially flat smooth surfaces, such as 181*a*, and 183*a*, shown in FIG. 1F for structure 180*a* and 182*a*, respectively, which do not dig into the ground 150 and which may be rectangular, circular, or any other shape.

The mat 100 may be made of a flexible bendable plastic. There may be any number of supporting or stakes such as 110*a-i*, which are driven into the ground 150 and there may be any number of supporting structures, such as 180 and 182, which sit on top of the ground 150.

In operation, when a person strikes the golf ball 160 in a conventional manner with a golf club head, by swinging a shaft connected to the golf club head, the golf club head may impact the mat 100 just before, during or after the moment of impact of the club head with the ball 160 of FIG. 1B. Since the mat 100 is elevated a distance D1 off of the ground 150, the mat 100 will deflect downward into the void or cavity 105 in-between a bottom surface 101*b* of the ground sheet or body portion 101 and the ground 150. The body portion 101 may touch the ground 150 during deflection; however, the mat 100 prevents the golf club head from digging into the ground or ground surface 150. The mat 100 thus absorbs the impact of the golf club head and the golf club head does not cause a divot, i.e. the dislocation, by the roots, of grass blades 170 from the ground 150. The blades of grass 170 may be sheared off, but will not be completely removed by the roots, since the golf club head cannot dig into the ground 150.

Figure 2A:
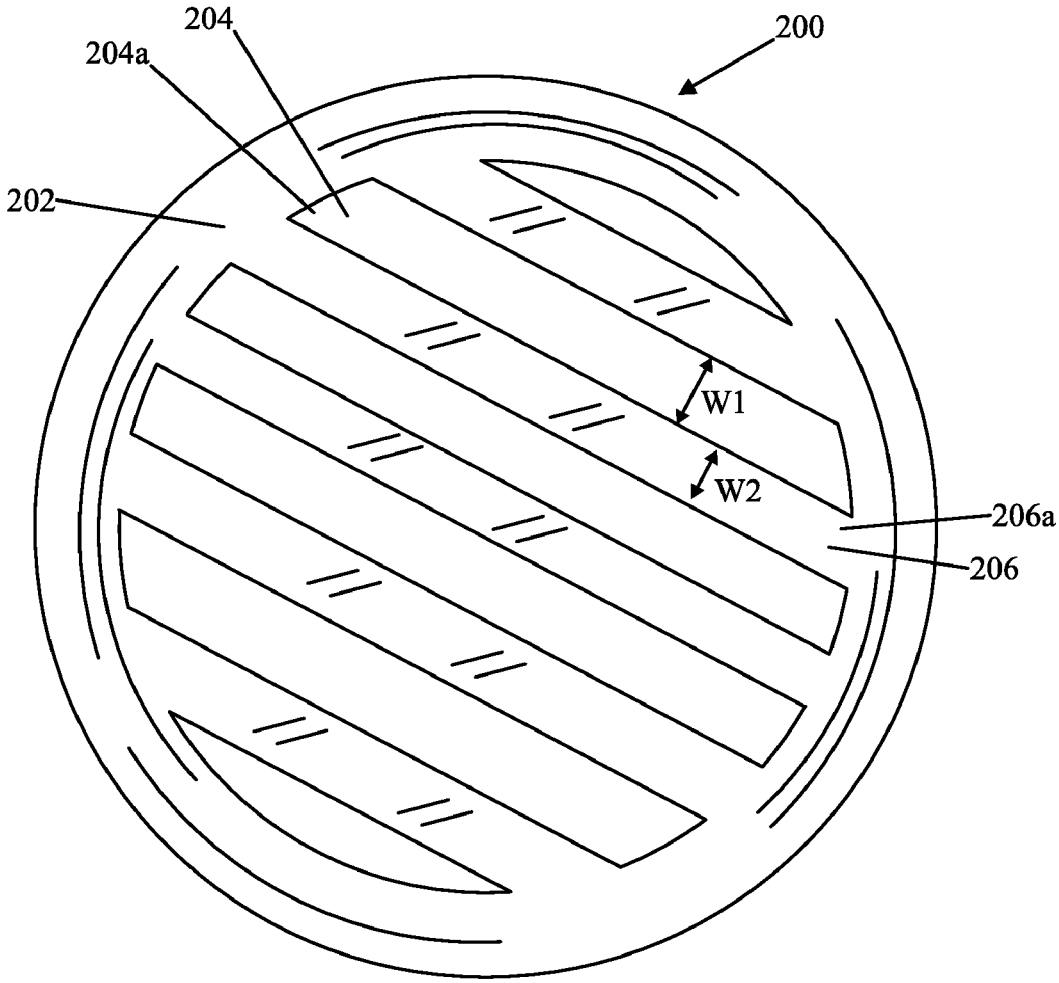
FIG. 2A shows a top view of another golfing mat in accordance with another embodiment of the present invention.
Figure 2B:
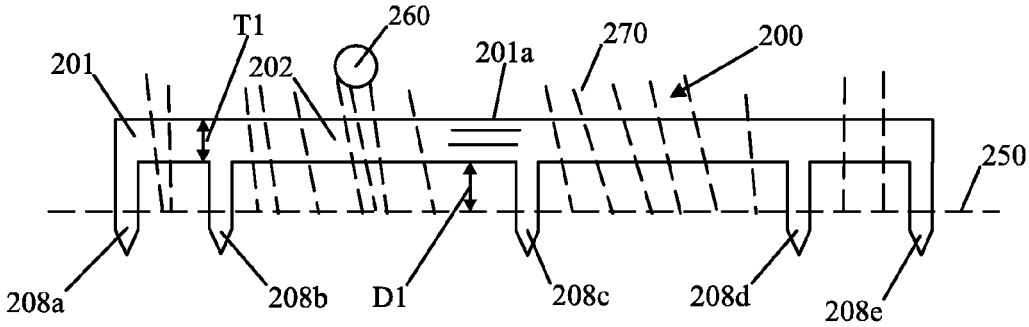
FIG. 2B shows a front view of the golfing mat of FIG. 2A.
Figure 2C:
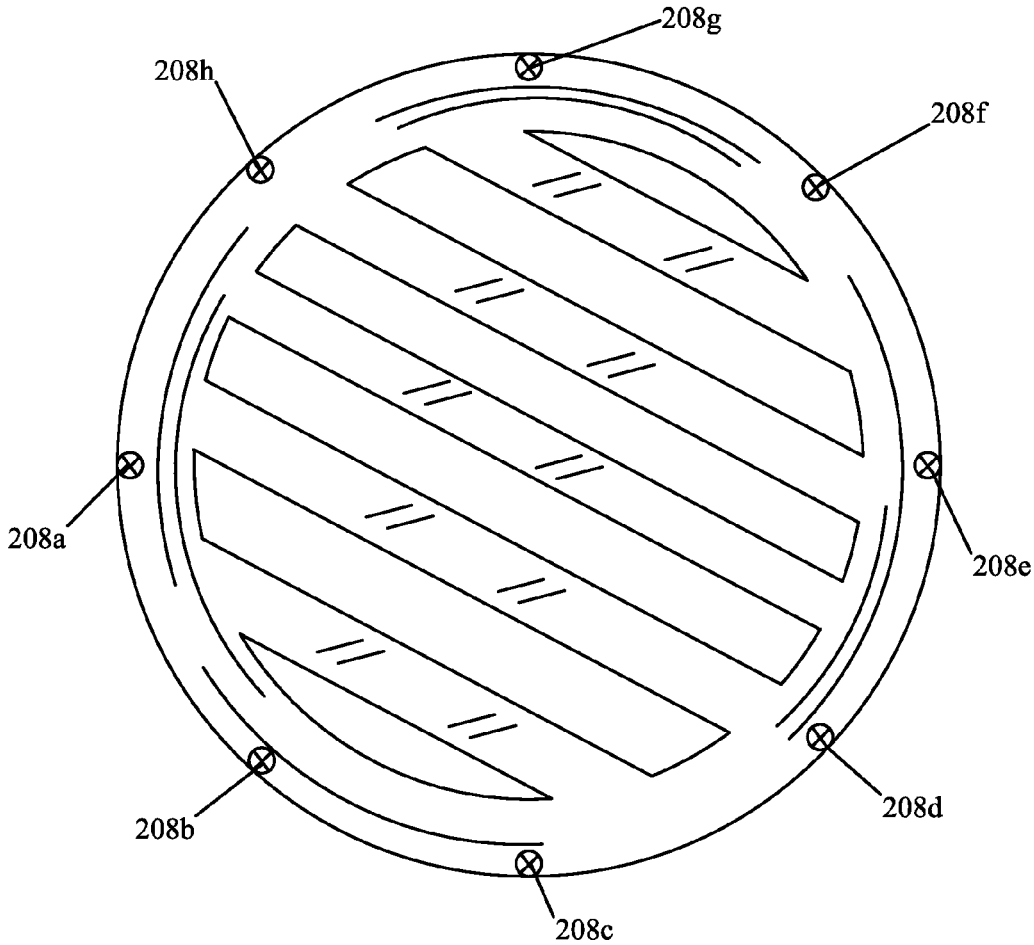
FIG. 2C shows a bottom view of the golfing mat of FIG. 2A.

FIG. 2A shows a top view of a golfing mat 200 in accordance with another embodiment of the present invention. FIG. 2B shows a front view of the golfing mat 200 of FIG. 2A. FIG. 2C shows a bottom view of the golfing mat 200 of FIG. 2A. The golfing mat 200 may be substantially circular or circular. The golfing mat 200 may include a substantially circular peripheral edge 202, and support members or rails 206, including member 206*a*. The Golfing mat 200 may have a plurality of elongated openings or slots 204, including slot or elongated opening 204*a*. The golfing mat 200 may include a plurality of stakes, or spiked or pointed posts or members 208*a*, 208*b*, 208*c*, 208*d*, 208*e*, 208*f*, 208*g*, and 208*h*, as shown by FIGS. 2B-2C. The stakes 208*a*-208*e* are shown inserted into a ground surface 250, shown by horizontal dashed lines, in FIG. 2B. The stakes 208*g-h* would typically by simultaneously inserted into the ground surface 250 along with the stakes 208*a-e*, but are not shown in FIG. 2B. A golf ball 260 can be placed on top of one or more blades of grass of plurality of blades of grass 270, shown by substantially vertical dashed lines in FIG. 2B. The golf ball 260 may be placed on blades of grass of grass 270 so that the golf ball 260 does not touch a top surface 201*a* of the mat 200. The blades of grass 270 come up through or pass through the slots 204.

Each of the elongated slots 204 (which the exception of the two end slots) may have a width W1 which may be three sixteenths of an inch. Each of the elongated strips or members 206 may have a width W2, which may be three quarters of an inch. The mat 200 may include a body portion 201 which may have a thickness T1 which may be one eighth of an inch.

In operation, when the golf ball 260 on the mat 200 is struck in a downward striking action with a golf club head from a strung golf club, the body portion 201 of the mat 200 will deflect towards the ground or ground surface 250. The body portion or ground sheet 201 can be inserted so that it is flush with the ground surface 250 or so that it is elevated above the ground surface 250 such as by a distance D2 which may be one inch. Whether the body portion 201 or ground sheet is elevated above the ground 250 or inserted using stakes or legs 208*a-h* so that it is on the ground surface 250 (i.e. D2=0), the body portion 201 or ground sheet prevents a golf club head from digging into soil below the grass and thus preserves a lawn.

The mat 100 or the mat 200 may be further secured with U-shaped pegs which can be inserted through holes 108 or slots 204 and into the ground 150 or 250. For example, a U-shaped peg 190, a top view of which is shown in FIG. 1A, may have one leg inserted through one of openings 108 and inserted into the ground 150, as shown by FIG. 1A, and the dashed lines for U-Shaped peg 190 in FIG. 1E, and may have another leg simultaneously inserted into the ground 150, shown in FIG. 1E, through another of openings 108, shown in FIG. 1A, thereby helping to hold the mat 100 in place. The U-shaped peg 190 may be made of plastic and may have a length L2, shown in FIG. 1E, of four inches.

Figure 3:
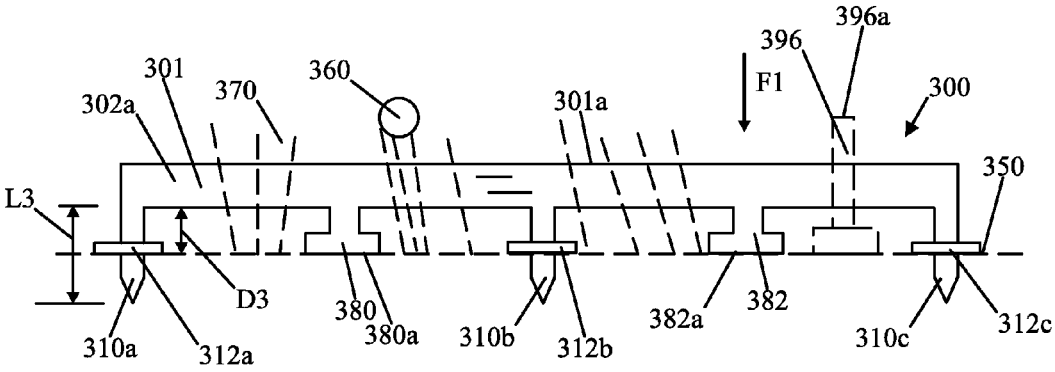
FIG. 3 shows a rear view of a golfing mat in accordance with another embodiment of the present invention.

FIG. 3 shows a rear view of a mat 300 in accordance with another embodiment of the present invention. The mat 300 may be identical to the mat 100 of FIGS. 1A-1E, except as specified as follows. The mat 300 may include components 301, 302*a*, 310*a-c*, 380, and 382, similar to components 101, 102*a*, 110*a-c*, 180, and 182, respectively for the mat 100 of FIGS. 1A-1E. FIG. 3 also shows a golf ball 360, ground surface 350, and grass blades 370, similar to golf ball 160, ground surface 150, and grass blades 370 in FIGS. 1B-1E. Unlike the mat 100, the mat 300 includes cross members 312*a*, 312*b*, and 312*c* connected to the periphery of stakes, legs, or posts 310*a*-310*c*, respectively. The cross members 312*a-c* prevent the stakes 310*a-c*, respectively, from going farther into a ground surface 350 than shown in FIG. 3. The cross members 312*a-c* may have surround the stakes 310*a-c*-respectively, as viewed from the top or bottom. When a forced is applied to the body portion 301 of the mat 300 to force the stakes 310*a*-310*c* into the ground 350 in the direction F1, the cross members 312*a-c* impact with the ground surface 350, but do not substantially cut into the ground surface. The cross members 312*a-c* typically have a wide smooth cross section as viewed from above or below, so that the cross members 312*a-c* do not substantially cut into the ground 350. Thus with the stakes 310*a-c* driven into the state shown in FIG. 3, a distance D3 between the body portion 301 and the ground 350 has been set and when a golf club head impacts the top surface 301*a* of the body portion 301, the golf club head does not drive the stakes 310*a-c* further into the ground 350. FIG. 3 also shows a golf tee, or golf ball support 396 which can be inserted through an opening in the body portion 301 (similar to one of openings 108 of mat 100 of FIG. 1A). A golf ball can be placed on a top 396*a* of the golf ball support 396.

Figure 4A:
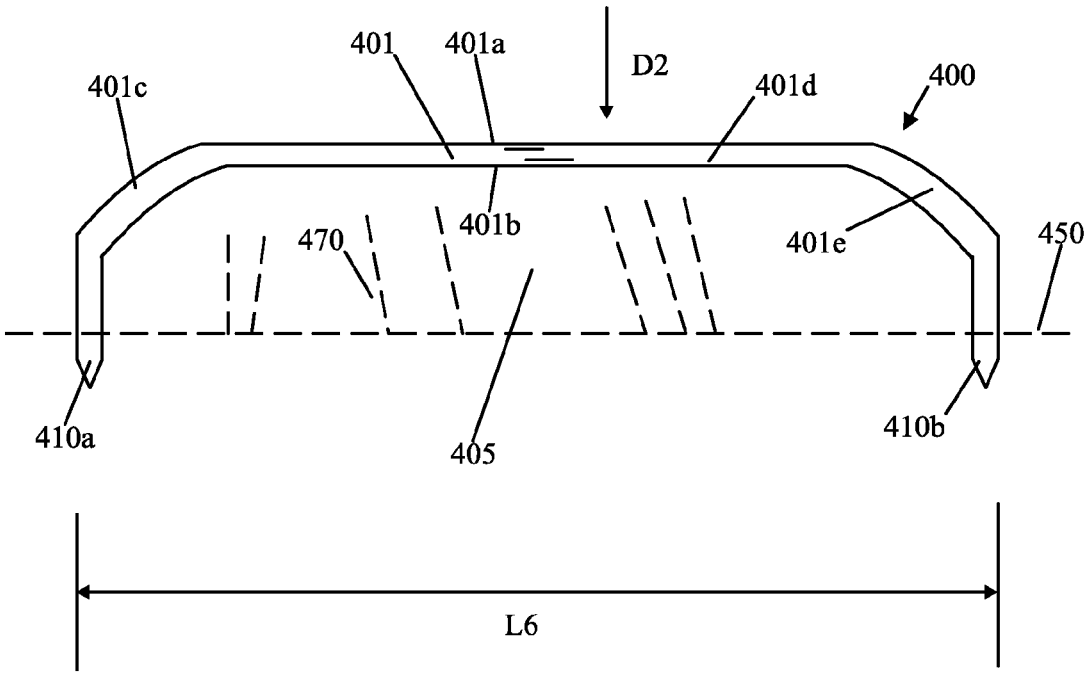
FIG. 4A shows a side view of a golfing mat in accordance with another embodiment of the present invention.

FIG. 4A shows a side view of a mat 400 in accordance with another embodiment of the present invention. Unlike the body portion 101 of the mat 100, the body portion 401 may not have any openings, i.e. no openings similar to openings 108 shown in FIG. 1A for grass blades 470 shown by dashed lines in FIG. 4 to go through. The body portion 401 may have an inclined, arched, or slanted section 401*c*, a straight, flat, or substantially straight or substantially flat section 401*d*, and an inclined, arched, or slanted section 401*e*. The arched or slanted sections 401*c* and 401*e* create a greater cavity 405 (than if there was only a straight section 401*d* with no arched sections), while the section 401*d* allows a golf ball to be placed at various locations on the surface 401*a* without falling off of the surface 401*a*. The straight or substantially straight section 401*d* is typically substantially perpendicular or perpendicular to stakes, posts, or legs 410*a* and 410*b*.

The mat 400 may have a length of L6, and may have a similar width so that the mat 400 may be square, substantially square or rectangular, and have an area for body portion 401 of about eighteen square inches. The mat 400 and mats 100, 200, and 300 may be lightweight so that they do not smother grass underneath the mat, such as grass blades 470 underneath mat 400 in FIG. 4A. A lightweight material for the mats 100, 200, 300, and 400 allows the mats to be inserted into a ground surface, such as 450, then used for hitting golf balls, while inserted into the ground surface, such as 450, and thereafter removed from a ground surface, such as 450, after use. Although holes are not provided in the mat 400 shown in FIG. 4A, holes could optionally be provided for mat 400 similar to the holes 108 in FIG. 1A or similar to the slots 204 in FIG. 2A.

Figure 4B:
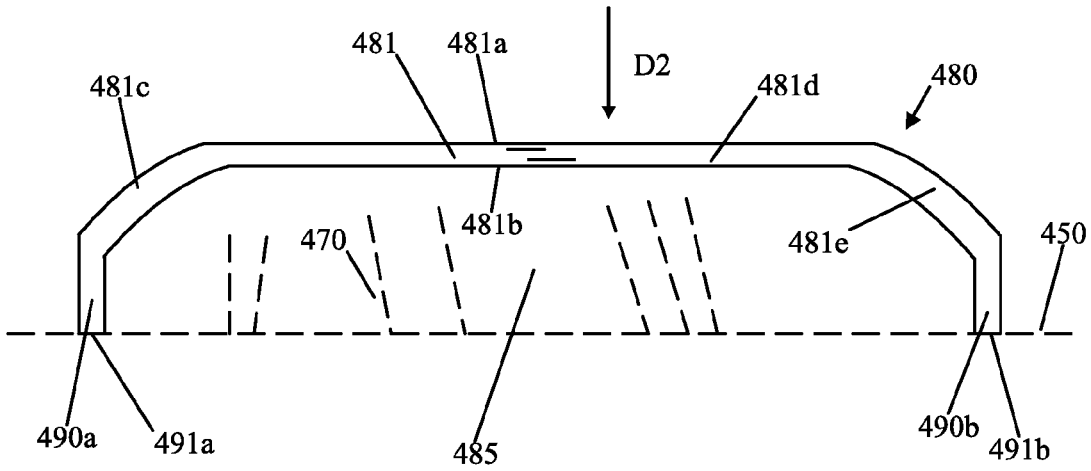
FIG. 4B shows a side view of a golfing mat in accordance with another embodiment of the present invention.

In another embodiment, shown in FIG. 4B, a mat 480 is provided. The mat 480 mat be similar to the mat 400 of FIG. 4A except as will be described. The mat 480 may include components 481, 481*a*, 481*b*, 481*c*, 481*d*, and 481*e* which may be similar to or identical to the components 401, 401*a*, 401*b*, 401*c*, 401*d*, and 401*e*, respectively for mat 400. However, the mat 480 may include legs or members 490*a* and 490*b* which have smooth flat bottom surfaces 491*a* and 491*b* shown in FIG. 4B. A cavity 485 lies underneath a bottom surface 481*b* for the mat 480 in FIG. 4B.

The mat 480 can be shaped like a large frisbee (or circular disk) that sits on the ground, where the edges, corresponding to stakes 490*a* and 490*b* sit on the ground, i.e. do not have pointed or sharp edges for being inserted into the ground 450. The top view of the shape of the mat 400 or 480 (not shown) can be various shapes, such as rectangular, similar to FIG. 1A for mat 100 or substantially circular or circular, such as similar to mat 200 shown in FIG. 2A.

The ground sheets 401 or 481 of FIGS. 4A and 4B, respectively, may be domed or arched for approximately eight inches (i.e. the length in the orientation or direction of line L6 of arched section 401*c* and arched section 401*e* may each be eight inches and the length along the direction of section 401*d* may be eighteen inches. The domed, arched or curved nature of the body portion or ground sheet 401 creates a cavity 405 is created between the body portion 401 or ground sheet and the ground 450 below it. Downwardly moving a golf club head that impacts the body portion 401 or ground sheet will deflect the portion of the ground sheet in the vicinity of the point of impact downwardly in the direction D2. The body portion 401 or ground sheet may deflect bottom surface 401*b* all the way down into the ground 450, but the golf club head will not travel through the body portion or ground sheet 401. The ground sheet or body portion 401 thereby prevents the golf club head from digging up the ground 450 and grass 470 below the area of impact.

Figure 5A:
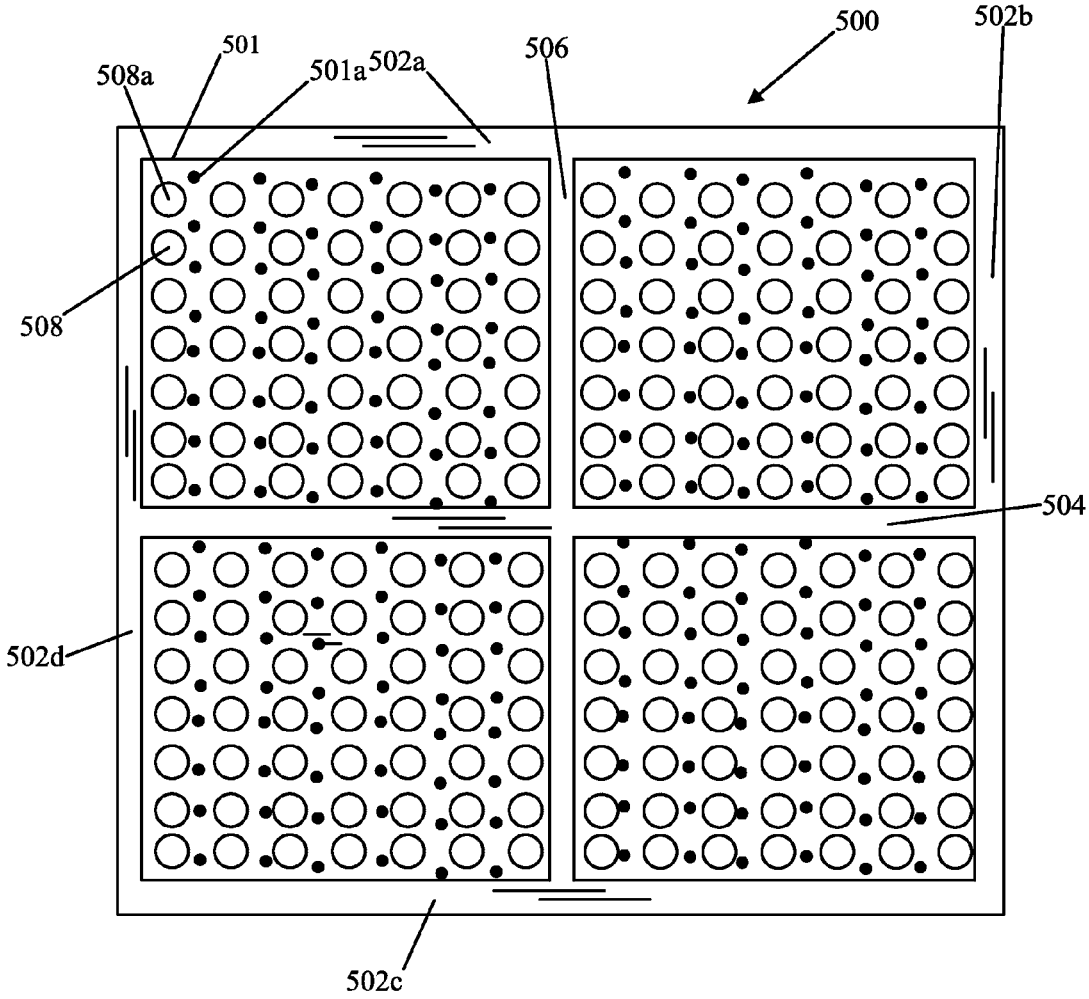
FIG. 5A shows a top view of a golfing mat in accordance with another embodiment of the present invention.

FIG. 5A shows a top view of a golfing mat 500 in accordance with an embodiment of the present invention, which may be identical to the golfing mat 100 of FIG. 1A, except as will be described. The golfing mat 500 includes components 501, 502*a-d*, 504, 506, 508, and 508*a* which may be identical to components 101, 102*a-d*, 104, 106, 108, and 108*a* shown in FIG. 1A. The golfing mat 500 may also include stakes, similar to stakes 110*a-i*, and support structures 180 and 182, not shown in FIG. 5A. However, for the golfing mat 500, a top surface 501*a* of the body portion 501 is made of a synthetic turf or artificial grass material. Thus, for the mat 500, real grass blades can come through the openings 508 while at the same time there is an artificial turf or grass surface 501*a*. The real grass blades coming through the openings 508, effectively, mix in with the artificial turf surface of surface 501*a*. A golf ball can be placed on either the grass blades coming through the openings 508, the artificial turf surface 501*a*, or both.

Figure 5B:
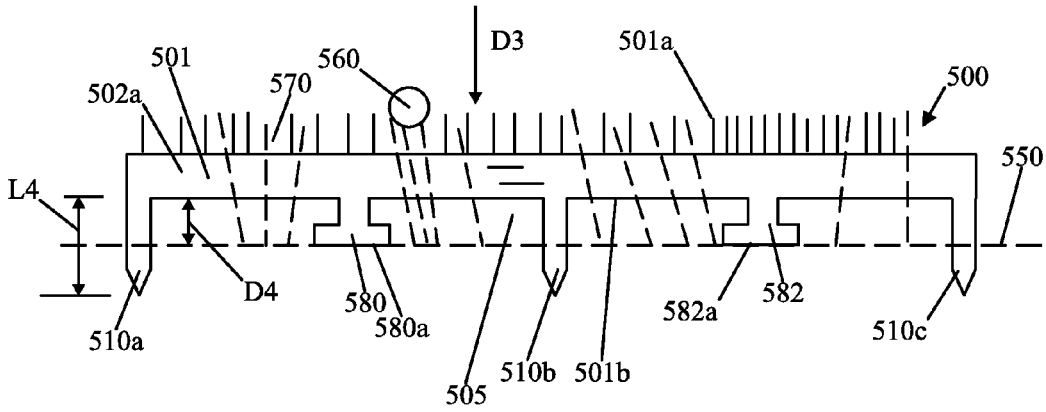
FIG. 5B shows a rear view of the golfing mat of FIG. 5A.

FIG. 5B shows a rear view of the golfing mat 500. As shown in FIG. 5B, the golfing mat 500 includes components 501, 501*a*, 502*a*, 510*a*-510*c*, 580, and 582, which may be identical to the components 101, 101*a*, 102*a*, 110*a*-110*c*, 180, and 182, respectively, except as will be described. The body portion or ground sheet 501 includes the top surface 501*a* which may include artificial or synthetic turf as shown by solid lines for 501*a* in FIG. 5B and as shown by dark spots in FIG. 5A. The body portion or ground sheet 501 may also have a bottom surface or material 501*b* which may be made of a solid but flexible material such as polyethylene plastic. Grass 570 shown by dashed substantially vertical lines in FIG. 5B has roots in ground 550. A golf club head, when swung in a conventional manner to hit a golf ball 560 impacts the body portion 501 or ground sheet as it strikes the golf ball 560 and the ground sheet yieldable resists the downward force exerted by the golf club head, in the direction D3 as it deflects downwardly in the direction D3 into the cavity 505 between the body portion 501 or ground sheet and the earth or ground surface 550 beneath it. The earth or ground 550 beneath the ground sheet receives the deflected portion of the ground sheet or body portion 501 and also yieldable resists the downward deflection, in the direction D3 of the ground sheet or body portion 501 that has deflected into the cavity 505 and into the ground 505 below. The ground sheet or body portion 501 prevents the golf club head from digging into the earth below the golf club head and thereby prevents the golf club head from digging out earth and grass roots below the club head.

Figure 6A:
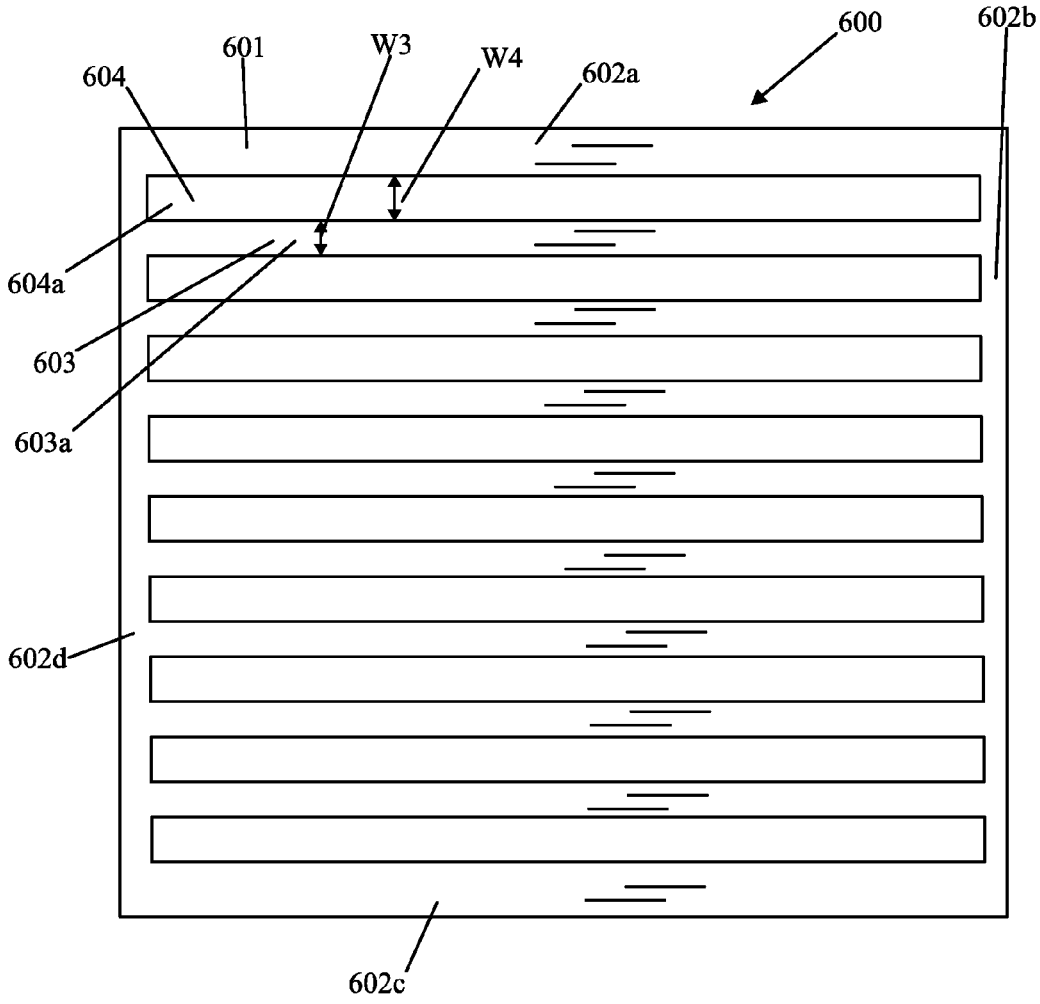
FIG. 6A shows a top view of a golfing mat in accordance with another embodiment of the present invention.
Figure 6B:
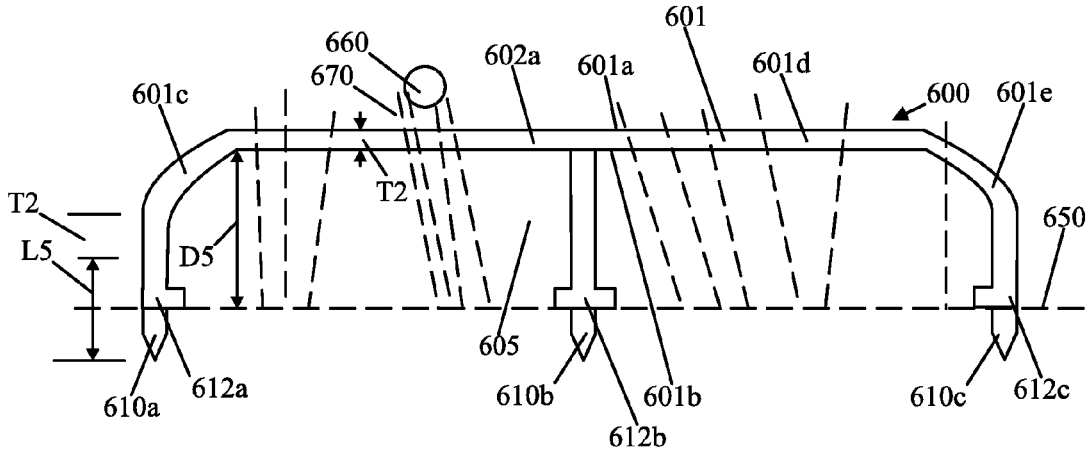
FIG. 6B shows a rear view of the golfing mat of FIG. 6A.

FIG. 6A shows a top view of a golfing mat 600 in accordance with another embodiment of the present invention. FIG. 6B shows a rear view of the golfing mat 600 of FIG. 6A. Golfing mat 600 has elongated slots or openings 604, including slot 604*a*. The golfing mat 600 may include a plurality of strips 603, including strip 603*a* between the slots 604. Each slot of slots 604 may have a width W4 shown in FIG. 6A of three quarters of an inch. The slots or openings 604 may be spaced apart from each other by a width of W3 (i.e. the width of each strip or slat of 603, such as strip 603*a*) which may be one quarter of an inch. Each of the strips of strips 603 may have a thickness T2, such as shown in FIG. 6B which may be about one half of an inch.

The mat 600 may have a body portion 601, and sides 602*a*, 602*b*, 602*c*, and 602*d*. The mat 600 may include wall extensions or pointed or edged posts 610*a*, 610*b*, and 610*c* shown in FIG. 6B and further wall extensions not shown. The wall extensions or posts 610*a-c* may have attached thereto or integrated therewith supports 612*a-c*, respectively, which prevent the wall extensions or posts 610*a-b* from going further into a ground surface 650 than shown in FIG. 6B.

The body portion 601 of the mat 600 may include curved, arched or slanted sections 601*c* and 601*e* which are not aligned with the stake or wall 610*a* and 610*c*, respectively, and which are not perpendicular to the stake or walls 610*a* and 610*c* respectively. The body portion may also include straight, flat, or substantially flat or straight section 601*d* which is perpendicular or substantially perpendicular to the walls or stake 610*a* and 610*c*.

Grass blades 670 shown by substantially vertical dashed lines in FIG. 6B, come up through the slots 604 in FIG. 6A, and a golf ball 660 can sit on the grass blades 670. The extensions or posts, or walls 610*a*-610*c* may be L5 long which may be five inches. A bottom surface 601*b* of the body portion 601 may be D5 inches one quarter of an inch above the ground surface 650 creating a gap or cavity 605 into which the body portion 601 can deflect downwards when a golf club head impacts the body portion 601. The curved sections 601*c* and 601*e*, create a larger cavity 605, while the straight section 601*d* allows the ball 660 to sit on the surface 601*a* without falling off of the surface 601*a*.

The extensions or posts 610*a*-610*c* may be replaced by or may be extended side walls. For example, portion 602*a* may have an extended side wall having a bottom edge for going into the ground 650. Similarly portions 602*b-d* may have extended side walls for going into the ground 650. The extensions or posts 610*a*-610*c*, or any extended side walls for going into the ground 650 typically extend at right angles to the body portion 601 and when 610*a-c* or extended side walls are inserted into the ground, they are designed to keep the mat, such as 600, affixed to the ground 650 and also elevated above the ground 650.

The extensions or posts 610*a-c* or any extended side walls for inserting into the ground 650 in at least one embodiment, can be inserted four inches into the ground. The extensions or posts 610-*a* and any extended side walls for inserting into the ground can be located in a several places around the perimeter of the mat 600. The extensions or posts and any extended side walls for inserting into the ground can extend from the body portion at an angle that is less than ninety degrees, rather than a right angle, from the ground sheet so that it is easier to insert into the ground. Furthermore the angled edge of the extension walls helps to keep the ground sheet from being pushed into the ground which would have the unwanted consequence of decreasing the depth of the cavity between the ground sheet and the surface of the ground.

Each of the body portions or ground sheets 101, 201, 301, 401, 481, 501, and 601 may have a thickness, such as thickness T1 in FIG. 2B, which may be three eighths (⅜) of an inch.

The ground sheets or body portions 101, 201, 301, 401, and 501, can be made of a solid material or can be a softer, rubbery type of material that will compress downwardly such as artificial turf.

The ground sheet 501 of FIG. 5B can be comprised of both a compressible material such as a rubbery artificial turf for surface or portion 501*a*, and a solid material such as a polyethylene plastic or composite such as carbon fiber composite, or any other solid and flexible material for portion or surface 501*b*.

The ground sheets or body portions 101, 201, 301, 401, and 501 can be comprised of a material that is partially solid and deflectable for a bottom part or surface of the body portion, and a material that partially softer and compressible material for the top part or surface of the body portion. For instance the ground sheet or body portions 101, 201, 301, 401, and 501 can be comprised of a solid lower or bottom layer of approximately 3⁄16 (three-sixteenths) of an inch thick carbon fiber plastic composite and a ⅓ (one-third) inches thick compressible material such as synthetic grass turf.

A ground sheet or body portion that is made of a solid material that can deflect downward when it is impacted in a downwardly direction, such as in the direction of F1 in FIG. 3, the direction of D2 in FIG. 4, and the direction of D3 in FIG. 5 by a moving golf club head that is attached to a golf club shaft and is swung by a golfer. A solid semi rigid material for the body portion or ground sheet of body portions 101, 201, 301, 401, and 501, allows the moving golf club head to skip across the surface, such as surfaces 101*a*, 201*a*, 301*a*, 401*a*, 501*a* of the appropriate body portion in a similar way that a golf club head skims through the grass when it takes a divot. Importantly, the deflectable ground sheet prevents the golf club head from taking a dirt divot and/or digging up the lawn, while allowing the golfer to swing as if he were swinging a golf club to hit a ball on a grass fairway.

The ground sheet, such as one of body portions 101, 201, 301, 401, and 501, can also be compressible so that when a swinging golf club makes contact with it in a downward direction, the ground sheet will compress and also deflect downwardly into a space or cavity, or earth below it. The ground sheet can be partially solid and partially soft and compressible flexible so that, for instance, the top surface layer of the ground sheet can be made of a compressible material such as artificial turf, and the bottom layer of the ground sheet can be made of a solid, but flexible material, such as polyester plastic or a composite or any other material.

The ground sheet, such as one of body portions 101, 201, 301, 401, and 501 can be placed on top of the ground and held in place by its own weight and/or it can be held in place to the ground by any means including the use of spikes or other protrusions that are either selectively affixed to the ground sheet and pressed into the ground or that are permanently affixed to the ground sheet and inserted into the ground.

When the ground sheet, such as one of body portions 101, 201, 301, 401, and 501 is placed on a ground surface, the ground sheet deflects downward into the ground when impacted by a downwardly moving golf club head. The ground receives and yieldingly resists said downwardly bodily deflected sheet portion so that that it stops the moving golf club head from digging into the ground below the ground sheet. In addition, the resultant deflection of the ground sheet and the yielding resistance of the compactable earth below the sheet soften the blow so the golfer does not absorb all of the impact caused by the golf club head striking the ground sheet.

The ground sheet, such as one of body portions 101, 201, 301, 401, and 501 can be semi embedded into the ground so that the top surface of the ground sheet is level with the surface of the ground or it can protrude above the ground level. For instance a dome shaped ground sheet, such as 401 in FIG. 4, can be provided so that the bottom edges of the ground sheet or 401 can be inserted into the ground, or stakes 410*a-b* at the bottom edges, to hold it in place while a substantial portion of the ground sheet or body portion 401 is on top of the ground surface, such as 450.

When the ground sheet is partially embedded into the ground the top surface of the ground sheet is level with the ground or slightly above the ground. When a golf club head that is attached to a golf club shaft that is swung by a golfer strikes the top surface of the ground sheet, the ground sheet can compress downward and may also deflect slightly downward into the ground below. The ground sheet can be elevated above the ground by any means including the use of ground spikes that extend from the ground sheet into the ground. The ground sheet and/or spikes that are inserted into the ground can have spacers between the bottom of the ground sheet and the top of the ground that prevent the ground sheet from being pushed down to the surface of the ground. Thus, the ground sheet can be elevated above the ground so that a cavity is created between the bottom of the ground sheet and the top of the ground. The grass that grows beneath the ground sheet can also support the ground sheet so that it is completely, or partially elevated above the ground from which the grass grows.

When the ground sheet, such as one of 101, 201, 301, 401, and 501 is elevated above the ground a cavity is created between the bottom of the ground sheet and the top of the ground. For instance a portion of the bottom surface of the ground sheet can be elevated approximately one half inch above the surface of the ground below it. The distance that the ground sheet is elevated above the ground can be adjusted by the user who can insert a portion of the ground sheet or the ground sheet spikes to a selected depth. Usually, the ground sheet is elevated so that the top surface of the ground sheet is approximately even with the top of the grass that has been cut one inch above the ground. However the height of the mat can be adjusted by the user. For instance if the legs or stakes, such as stakes 110*a-i* of FIGS. 1A-1E that can be attached to the ground sheet 101 are six inches long (L1 as shown in FIG. 1B), they can be inserted five inches into the ground so that the ground sheet is elevated one inch (D1 shown in FIG. 1B) above the ground, such as ground 150. The more the ground sheet is elevated the more area there is for the ground sheet to deflect downward before ever impacting the ground below it.

The ground sheet, such as 101 in FIG. 1B, can be elevated a distance D1 above the ground 150, for instance one inch or more above the ground 150 so that when a golfer swings his golf club and the golf club head impacts the ground sheet downwardly, the bottom, such as 101*b* in FIG. 1B of the ground sheet, such as 101, never makes any contact with the grass, such as grass 170.

When a golfer swings a golf club containing a golf club head and downwardly impacts the ground sheet 101 that is elevated above the surface, such as ground surface 150 of the ground the ground sheet deflects into a cavity, such as 105. The ground, such as 150 forming the bottom of the cavity 105 can also receive a portion of the ground sheet, such as 101, deflected downwardly into the cavity 105.

The ground sheet, such as 101 can have a hole in the surface so that a golf ball support such as a tee 396 shown in FIG. 3, which may be an elastomeric stem, can be selectively inserted and used as a golf tee. For instance the ground sheet, such as 301 (or 101, 201, or 501) can have a hole that goes through the surface, similar to holes 108 so that a golf support stem, such as 396 can be inserted into a hole of holes 108 to secure 396 in place so that it protrudes though the ground sheet, such as 101, and extends above the surface of the ground sheets and remains in place there even when struck by a golf club head.

The ball support can, such as 396 in FIG. 3, also be permanently attached to the ground sheet, such as 301, by any attachment means known including plastic molding.

When a golfer swings a golf club so that the golf club head strikes the ball support stem or tee 396, the typically flexible ball support stem 396 bends away and allows the golf club head to pass by, and thereafter it reverts back to its original position. Thus, the golfer can place another golf ball on top of it, or simply use it as a target while practicing his golf swing.

The ground sheet can have a plurality of holes, such as 108, that transect completely through the surface or through the body portion, such as 101, 201, 301, and 501. The holes 108 can be large enough for grass to grow through and small enough so that the head of a golf club can not go through them. Grass can grow from the ground or earth and then through the holes in the ground sheet, such as one of 101, 201, 301, and 501.

When a golf club head that is attached to a golf club shaft that is swung by a golfer impacts the grass growing through the holes, such as 108 in the ground sheet, the grass, such as 170 in FIG. 1B is shaved from the top surface, such as 101*a* of the mat 100 yet the roots of the grass 170 in the ground 150 remain intact. Thus, instead of the grass below the ground sheet being smothered and killed as with a conventional golf mat, the ground sheet described herein allow the grass below it to grow. This also has the advantage of allowing the golfer to take a divot as he/she would when hitting a golf ball with a golf club from a real golf course fairway. In addition the grass that grows through the holes in the ground sheet obscures and hides the ground sheet so that it blends in with the surrounding lawn around it.

The ground sheet, such as one of 101, 201, 301, and 501, can easily be moved to new locations when the grass that grows through the holes (holes 108 or holes identical to or similar to) in the mesh of the ground sheet become shaved off after repeated practice golf swings. The ground sheet, such as one of 101, 201, 301, 401, and 501, can be any dimension, and of any surface area suitable to the user. For example the ground sheet can be, for instance rectangular, square, and circular or in the various shapes. It can be conical, flat or it can have inundations. It can be, for instance eighteen inches by thirty-six inches or, it can have a diameter of thirty-inches. The ground sheet can be any thickness so long as it can deflect when stuck by a golf club head swung by a golfer and so long as it will withstand the impact of the golf club head without breaking apart.

For the ground sheets or body portions 401 and 601, although the inclined or ramped sections 401*c* and 401*e* and 601*c* and 601*e* have been described as being part of the body portions 401 and 601, respectively, the inclined sections can be described as being separate from the respective body portions. For example, each of sections 401*d* and 601*d* by themselves, (the flat sections which are substantially parallel to the ground surfaces 450 and 650, respectively) may be described as body portions or ground sheets, which are connected to inclined sections (such as the appropriate inclined sections of 401*c* and 401*e* or 601*c* and 601*e*).

The majority of the rectangular bottom surface area for body portion 101 (underneath the top surface 101*a* shown in FIG. 1A,)

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A golf mat comprising:

a body portion; and means for holding the body portion in a position which is elevated a first distance above a ground surface;

wherein the means for holding the body portion is connected to the body portion so that the means for holding the body portion is substantially perpendicular to the body portion;

wherein the body portion and the means for holding the body portion are configured so that when the body portion is placed so that it is substantially parallel to the ground surface and elevated above the ground surface, and the means for holding the body portion is in contact with the ground surface, the majority of the body portion is not in contact with the ground surface so that there is a cavity beneath the body portion in which natural grass from the ground surface can grow without being restrained at least to a height of the first distance;

wherein the body portion has a plurality of openings;

wherein natural grass from the ground surface can grow through the plurality of openings of the body portion;

and wherein each of the plurality of openings has a width which is smaller than a diameter of a golf ball so that the golf ball cannot pass through each of the plurality of openings.

2. The golf mat of claim 1 wherein each of the plurality of openings is a circular opening, and wherein the width of each of the plurality of openings is a diameter of each of the plurality of openings.

3. The golf mat of claim 1 further comprising a first inclined section; and a second inclined section; and wherein the means for holding the body portion includes first and second members, each of which is substantially perpendicular to the body portion;

wherein the first inclined section has a first end which is connected to a first end of the first member;

wherein the first inclined section has a second end which is connected to a first end of the body portion;

wherein the second inclined section has a first end which is connected to a first end of the second member;

wherein the second inclined section has a second end which is connected to a second end of the body portion;

wherein a second end of the first member is configured to contact the ground surface when the body portion is substantially parallel to the ground surface and when the golf mat is supported by the ground surface; and wherein a second end of the second member is configured to contact the ground surface when the body portion is substantially parallel to the ground surface and when the golf mat is supported by the ground surface.

4. The golf mat of claim 1 wherein the means for holding the body portion includes first and second sharp edged members which can be driven into the ground surface when the body portion is substantially parallel to the ground surface.

5. The golf mat of claim 1 wherein the means for holding the body portion includes first and second edged members, having first and second edges, respectively;

wherein each of the first and second edged members has a first portion which can be driven into the ground surface when the body portion is substantially parallel to the ground surface;

and wherein each of the first and second edged members has a second portion which prevents a periphery of the body portion from being driven downward when the body portion is impacted by a downward descending golf club head that is connected to a golf club shaft and swung by a golfer.

6. The golf mat of claim 5 wherein the means for holding the body portion includes first and second substantially flat members each of which has a surface which is substantially parallel to the first and second edges, of the first and second edged members respectively and wherein the first and second substantially flat members support the golf mat on the ground surface, contact the ground surface, and inhibit the first and second edged members from being driven more than a second distance into the ground surface.

7. The golf mat of claim 1 wherein each of the plurality openings in the body portion is an elongated slot.

8. The golf mat of claim 1 wherein the body portion has a top surface and a bottom surface; and and wherein the top surface of the body portion includes an artificial grass material.

9. The golf mat of claim 1 wherein the body portion is made of a flexible material which flexes when a golf club head impacts the flexible material.

10. The golf mat of claim 1 further comprising a golf ball support which is inserted into one of the plurality of openings in the body portion.

11. The golf mat of claim 1 wherein the plurality of openings include a first opening, a second opening, a third opening, a fourth opening, and a fifth opening, wherein the first, second, third, fourth, and fifth openings are in a first plane;

wherein the second, third, fourth, and fifth openings are above, below, to the right, and to the left of the first opening, so that the first opening is surrounded by the second, third, fourth and fifth openings.

12. The golf mat of claim 11 wherein the first opening is a first, second, third, and fourth distance away from the second, third, fourth, and fifth openings; and wherein each of the first, second, third, and fourth distances is less than a diameter of a golf ball.

13. A method comprising holding a body portion of a golf mat in a position which is elevated a first distance above a ground surface;

wherein the body portion is held so that there is a cavity in which natural grass from the ground surface can grow unrestrained at least to a height of the first distance;

and further comprising placing a golf ball on a top surface of the body portion;

and hitting the golf ball off of the golf mat by swinging a golf club in order to hit the golf ball with a golf club head of the golf club;

wherein the body portion has a plurality of openings;

wherein natural grass from the ground surface can grow through the plurality of openings of the body portion;

and wherein each of the plurality of openings has a width which is smaller than a diameter of a golf ball so that the golf ball cannot pass through each of the plurality of openings.

14. The method of claim 13 wherein wherein the body portion is held in the position so that it the body portion is substantially parallel to the ground surface, and the body portion is held by a means for holding the body portion which is substantially perpendicular to the body portion and which is in contact with the ground surface.

15. The method of claim 14 wherein the golf mat includes a first inclined section; and a second inclined section; and wherein the means for holding the body portion includes first and second members, each of which is substantially perpendicular to the body portion;

wherein the first inclined section has a first end which is connected to a first end of the first member;

wherein the first inclined section has a second end which is connected to a first end of the body portion;

wherein the second inclined section has a first end which is connected to a first end of the second member;

wherein the second inclined section has a second end which is connected to a second end of the body portion;

wherein a second end of the first member is configured to contact the ground surface when the body portion is substantially parallel to the ground surface when the golf mat is supported by the ground surface; and wherein a second end of the second member is configured to contact the ground surface when the body portion is substantially parallel to the ground surface and when the golf mat is supported by the ground surface.

16. The method of claim 14 wherein the means for holding the body portion includes first and second sharp edged members; and further comprising driving the first and second sharp edged members into the ground surface to fix the body portion in a position in which the body portion is substantially parallel to the ground surface and elevated the first distance above the ground surface.

17. The method of claim 14 wherein the means for holding the body portion includes first and second edged members, having first and second edges, respectively;

and further comprising driving the first and second edged members into the ground surface to fix the body portion in a position in which the body portion is substantially parallel to the ground surface and elevated the first distance above the ground surface;

wherein the means for holding the body portion includes first and second substantially flat members each of which has a surface which is substantially parallel to the first and second edges of the first and second edged members, respectively;

and wherein the first and second substantially flat members support the golf mat on the ground surface, contact the ground surface, and inhibit the first and second edged members from being driven more than a second distance into the ground surface.

18. The method of claim 13 wherein wherein the body portion is held in the position by a means for holding the body portion which is substantially perpendicular to the body portion and which is inserted into the ground.

19. The method of claim 13 wherein the plurality of openings include a first opening, a second opening, a third opening, a fourth opening, and a fifth opening, wherein the first, second, third, fourth, and fifth openings are in a first plane;

wherein the second, third, fourth, and fifth openings are above, below, to the right, and to the left of the first opening, so that the first opening is surrounded by the second, third, fourth and fifth openings.

20. The method of claim 19 wherein the first opening is a first, second, third, and fourth distance away from the second, third, fourth, and fifth openings; and wherein each of the first, second, third, and fourth distances is less than a diameter of a golf ball.

21. The method of claim 13 wherein each of the plurality of openings in the body portion is an elongated slot.

22. The method of claim 13 wherein the body portion has a top surface and a bottom surface; and and wherein the top surface of the body portion includes an artificial grass material.

23. The method of claim 13 wherein the body portion is made of a flexible material which flexes when a golf club head impacts the flexible material.

24. The method of claim 13 further comprising inserting a golf ball support into one of the plurality of openings in the body portion.

25. The method of claim 13 wherein the plurality of openings include a first opening, a second opening, a third opening, a fourth opening, and a fifth opening, wherein the first, second, third, fourth, and fifth openings are in a first plane;

wherein the second, third, fourth, and fifth openings are above, below, to the right, and to the left of the first opening, so that the first opening is surrounded by the second, third, fourth and fifth openings.

26. The method of claim 25 wherein the first opening is a first, second, third, and fourth distance away from the second, third, fourth, and fifth openings; and wherein each of the first, second, third, and fourth distances is less than a diameter of a golf ball.

* * * * *